US010003136B2

(12) United States Patent
Ohnuma

(10) Patent No.: US 10,003,136 B2
(45) Date of Patent: Jun. 19, 2018

(54) CRIMP TERMINAL AND CRIMPING STRUCTURE WITH RESPECT TO ELECTRICAL WIRE THEREOF

(71) Applicant: YAZAKI CORPORATION, Tokyo (JP)

(72) Inventor: Kentaro Ohnuma, Shizuoka (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days. days.

(21) Appl. No.: 15/280,357

(22) Filed: Sep. 29, 2016

(65) Prior Publication Data

US 2017/0018858 A1 Jan. 19, 2017

Related U.S. Application Data

(63) Continuation of application No. 14/854,099, filed on Sep. 15, 2015, which is a continuation of application No. PCT/JP2014/057301, filed on Mar. 18, 2014.

(30) Foreign Application Priority Data

Mar. 19, 2013 (JP) ..... 2013-057170

(51) Int. Cl.
*H01R 4/18* (2006.01)
*H01R 43/048* (2006.01)
*H01B 1/02* (2006.01)

(52) U.S. Cl.
CPC ..... *H01R 4/185* (2013.01); *H01B 1/023* (2013.01); *H01R 4/18* (2013.01); *H01R 43/048* (2013.01)

(58) Field of Classification Search
CPC ..... H01R 4/185; H01R 4/184
See application file for complete search history.

(56) References Cited

U.S. PATENT DOCUMENTS 3,236,938 A * 2/1966 Toedtman ..... H01R 4/186 174/71 R
3,322,888 A * 5/1967 Zemels ..... H01R 4/186 174/71 R (Continued)

FOREIGN PATENT DOCUMENTS

CN 100481617 C 4/2009
JP 5-62721 A 3/1993

(Continued)

OTHER PUBLICATIONS

Communication dated Jul. 12, 2016, from the Japanese Patent Office in counterpart application No. 2013-057170.

(Continued)

*Primary Examiner* — Ross Gushi
(74) *Attorney, Agent, or Firm* — Sughrue Mion, PLLC

(57) ABSTRACT

A crimp terminal includes a conductor crimping portion having a U-shaped cross section and including a bottom plate and a pair of conductor caulking pieces extending upward from both side edges of the bottom plate. The other conductor caulking piece includes a bending portion being folded and is formed so that a tip positioned at a tip side from the bending portion faces downward. A pair of the conductor caulking pieces is bent inward so that the one conductor caulking piece overlaps on an upper side of the other conductor caulking piece and a conductor of an electrical wire to be connected is wrapped, and thereby a pair of the conductor caulking pieces caulks the conductor so as to closely contact on an upper surface of the bottom plate. Therefore, it is prevented that the conductor caulking piece opens after being caulked.

4 Claims, 8 Drawing Sheets

(56) References Cited

U.S. PATENT DOCUMENTS 3,330,903 A * 7/1967 Holke ..... H01R 4/186 174/71 R
3,335,392 A * 8/1967 Elliott ..... H01R 4/2495 439/423
3,404,368 A * 10/1968 Roberts ..... H01R 4/185 439/848
3,746,777 A * 7/1973 Peek ..... H01R 4/186 174/71 R
3,767,841 A * 10/1973 Anderson ..... H01R 4/2495 174/84 C
5,162,615 A * 11/1992 Schrader ..... H01R 4/186 174/71 R
5,396,033 A * 3/1995 Piriz ..... H01R 4/186 174/71 R
5,445,535 A * 8/1995 Phillips, Jr. ..... H01R 4/2495 439/394
5,561,267 A * 10/1996 Fudoo ..... H01R 4/185 174/84 C
5,635,676 A * 6/1997 Piriz ..... H01R 4/186 174/84 C
6,452,103 B1 * 9/2002 Piriz ..... H01R 4/186 174/71 R
6,552,271 B2 * 4/2003 Connor ..... H01R 4/20 174/84 C
6,565,377 B2 * 5/2003 Sawayanagi ..... H01R 12/68 439/422
6,747,211 B2 * 6/2004 Connor ..... H01R 4/20 174/84 C
7,316,581 B2 * 1/2008 Kumakura ..... H01R 4/182 439/422
7,562,449 B2 * 7/2009 Kuwayama ..... H01R 4/184 174/90
8,210,884 B2 * 7/2012 Corman ..... H01R 4/185 439/877
8,221,171 B2 * 7/2012 Ono ..... H01R 4/185 439/877
2002/0038511 A1 * 4/2002 Kuwayama ..... H01R 4/184 29/861
2005/0026515 A1 2/2005 Hashimoto et al.
2005/0050725 A1 3/2005 Kuwayama et al.
2008/0230269 A1 9/2008 Susai et al.
2013/0213710 A1 8/2013 Ohnuma et al.

FOREIGN PATENT DOCUMENTS

JP 2002-100452 A 4/2002
JP 2009-135022 A 6/2009
JP 4550791 B2 9/2010
JP 2012-84472 A 4/2012

OTHER PUBLICATIONS

Communication dated Sep. 20, 2016, from the Japanese Patent Office in counterpart application No. 2013-057170.
International Search Report for PCT/JP2014/057301 dated May 27, 2014.
Communication dated Sep. 30, 2016, from the State Intellectual Property Office of People's Republic of China in counterpart Application No. 201480016516.3
Communication dated Feb. 14, 2017, issued by the State Intellectual Property Office of P.R.C. in corresponding Chinese Application No. 201480016516.3.
Communication dated Jul. 28, 2017 from the State Intellectual Property Office of the P.R.C. in counterpart application No. 201480016516.3.
Communication dated Dec. 7, 2017, issued by the State Intellectual Property Office of the People's Republic of China in corresponding Chinese Application No. 201480016516.3.

* cited by examiner

CRIMP TERMINAL AND CRIMPING STRUCTURE WITH RESPECT TO ELECTRICAL WIRE THEREOF

CROSS-REFERENCE TO RELATED APPLICATION

This application is a continuation application of U.S. patent application Ser. No. 14/854,099, filed Sep. 15, 2015, which is a continuation application of International Application PCT/JP2014/057301, filed on Mar. 18, 2014, and designating the U.S., and claiming priority from Japanese Application No. 2013-057170 filed Mar. 19, 2013. The entire disclosures of the prior applications are considered part of the disclosure of the accompanying continuation application, and are hereby incorporated by reference.

BACKGROUND OF THE INVENTION

1. Field of the Invention

The present invention is related to a crimp terminal including a conductor crimping portion having a U-shaped cross section and including a pair of conductor caulking pieces, and a crimping structure with respect to an electrical wire of the crimp terminal.

2. Description of the Related Art

Conventionally, a crimp terminal is known which is crimped to an electrical wire when a pair of conductor caulking pieces caulks a conductor of the electrical wire by being bent inward so as to wrap the conductor (for example, refer to Japanese Patent Application Laid-open No. 2009-135022). In a crimping structure with respect to an electrical wire of a crimp terminal disclosed in Japanese Patent Application Laid-open No. 2009-135022, a pair of conductor caulking pieces caulks a conductor by being bent so that one conductor caulking piece overlaps on an upper side of the other conductor caulking piece. Specifically, both the conductor caulking pieces are bent so as to overlap each other.

FIGS. 7 and 8 illustrate an example of such a conventional crimping structure with respect to an electrical wire of a crimp terminal.

FIG. 7 is a perspective view illustrating an appearance of a crimping structure in which a conventional crimp terminal is crimped to an electrical wire.

FIG. 8 is a view illustrating a crimping process in the crimping structure illustrated in FIG. 7.

In each figure, a reference sign 100 denotes a crimp terminal, a reference sign 150 denotes an electrical wire, and reference signs 141 and 143 denote a lower die (anvil) and an upper die (crimper) of a crimp tool.

As illustrated in FIG. 7, the crimp terminal 100 includes an electrical connection portion 110, a conductor crimping portion 120, and a coating caulking portion 130. The electrical connection portion 110 is connected to such as a mating terminal on one end side (front side) in a longitudinal direction thereof (hereinafter the direction is described as "a front and back direction", and a direction orthogonal to the front and back direction is described as "a right and left direction"). The conductor crimping portion 120 is caulked, on the other end side (back side), to an exposed conductor 151*a* arranged on a tip of an electrical wire 150. The coating caulking portion 130 is caulked to an insulating coating 153 of the electrical wire 150.

In the above configuration, the exposed conductor 151*a* is a portion exposed from the insulating coating 153 at the tip of the electrical wire 150 including a conductor 151 and the insulating coating 153. The conductor 151 includes multiple bundles of strands in the form of such as a twisted wire. The insulating coating 153 is formed so as to coat a periphery of the conductor 151.

The electrical connection portion 110, the conductor crimping portion 120, and the coating caulking portion 130 include a common bottom plate 105.

As illustrated in FIG. 8(*a*), the conductor crimping portion 120 is a portion in which a pair of conductor caulking pieces 121*a* and 121*b* are erected on both end sides in the right and left direction of the bottom plate 105 extending continuously from the electrical connection portion 110. The conductor crimping portion 120 is formed so as to have a U-shaped cross section before caulking.

When the conductor crimping portion 120 of the crimp terminal 100 is crimped to the exposed conductor 151*a*, as illustrated in FIG. 8(*a*), first the crimp terminal 100 is mounted on a lower die 141, and the exposed conductor 151*a* is inserted between the conductor caulking pieces 121*a* and 121*b* and mounted on the bottom plate 105. As illustrated in FIGS. 8(*b*) to 8(*e*), by gradually descending an upper die 143, a tip side of the conductor caulking pieces 121*a* and 121*b* on an inner surface of the upper die 143 is gradually tilted inward, and finally the conductor caulking pieces 121*a* and 121*b* are bent so as to wrap the exposed conductor 151*a*. Thereby, as illustrated in FIG. 8(*f*), the exposed conductor 151*a* of the electrical wire 150 is caulked by the conductor crimping portion 120 and closely contacted to an upper surface of the bottom plate 105 and the conductor caulking pieces 121*a* and 121*b*. At this time, as illustrated in FIG. 8(*f*), a pair of the conductor caulking pieces 121*a* and 121*b* caulks the exposed conductor 151*a* by being bent so that the one conductor caulking piece 121*a* overlaps on an upper side of the other conductor caulking piece 121*b*. In the coating caulking portion 130 is caulked to the insulating coating 153 of the electrical wire 150 in advance as with the above description before caulking of the conductor crimping portion 120.

In the case where the conductor crimping portion 120 is crimped to the exposed conductor 151*a* of the electrical wire 150 by caulking the conductor caulking pieces 121*a* and 121*b*, it is expected that a conductive metal included in the crimp terminal 100 and the exposed conductor 151*a* are stuck, and the crimp terminal 100 and the electrical wire 150 are electrically, mechanically, and strongly bonded.

However, in a conventional crimp terminal and crimping method, the conductor caulking pieces 121*a* and 121*b* might be opened because a force (restoring force) in the direction in which the conductor caulking pieces 121*a* and 121*b* return to an original shape acts such as by spring back thereof after being caulked. As a result, a contact pressure with respect to the conductor 151 might become weak.

In the case where a contact pressure with respect to the exposed conductor 151*a* of the conductor caulking pieces 121*a* and 121*b* is not secured, a clamping force becomes weak, and therefore mechanical strength of a crimping portion might not be secured. Further, a proper resistance of the crimping portion cannot be secured. Specifically, electrical connection performance might be reduced since a contact resistance is increased.

Furthermore, in consideration of easiness in downsizing and recycling a vehicle, recently an aluminum electrical wire including aluminum as a conductor of an electrical wire can be used. Aluminum is less strong and ductile than copper and is easy to cause stress relaxation. Therefore, in the case of using an aluminum electrical wire, a contact pressure is especially likely to decrease.

SUMMARY OF THE INVENTION

An object of the present invention is, in view of the above-described circumstances, to provide a crimp terminal which can prevent that a conductor caulking piece opens after being caulked and a crimping structure with respect to an electrical wire of the crimp terminal.

To achieve the above-described object, a crimp terminal according to the present invention is characterized in points to be described below.

A crimp terminal according to the one aspect of the present invention includes a conductor crimping portion having a U-shaped cross section and including a bottom plate and a pair of conductor caulking pieces extending upward from both side edges of the bottom plate. Herein, one conductor caulking piece includes a bending portion being folded and is formed so that a tip positioned at a tip side from the bending portion faces downward. The pair of the conductor caulking pieces is bent inward so that the other conductor caulking piece overlaps on an upper side of the one conductor caulking piece and a conductor of an electrical wire to be connected is wrapped, and thereby the pair of the conductor caulking pieces caulks the conductor so as to closely contact on an upper surface of the bottom plate.

Further, to achieve the above-described object, the crimping structure with respect to an electrical wire of the crimp terminal according to the present invention is characterized in points to be described below.

A crimping structure with respect to an electrical wire of a crimp terminal according to the one aspect of the present invention includes the crimp terminal described above; and the electrical wire in which the crimp terminal is crimped. Herein, the pair of the conductor caulking pieces caulks the conductor so that the tip of the one conductor caulking piece sticks into the conductor.

In the crimping structure with respect to the electrical wire of the crimp terminal according to the another aspect of the present invention, the tip of the one conductor caulking piece sticks into the conductor in a state of being substantially orthogonally bent at the bending portion.

In the crimping structure with respect to the electrical wire of the crimp terminal according to the still another aspect of the present invention, the electrical wire is an aluminum wire including a conductor made of aluminum or aluminum alloy as the conductor.

The present invention has been briefly described above. In addition, details of the present invention will be clarified by reading through a description of an embodiment to be described below (hereinafter called an embodiment) with reference to attached drawings.

DETAILED DESCRIPTION OF THE PREFERRED EMBODIMENTS

An embodiment according to the present invention will be described below with reference to the drawings. Hereinafter, in the present description, a front side, a back side, an upper side, a lower side, a left side, and a right side will be specified as illustrated by arrows in FIG. 1.

Figure 1:
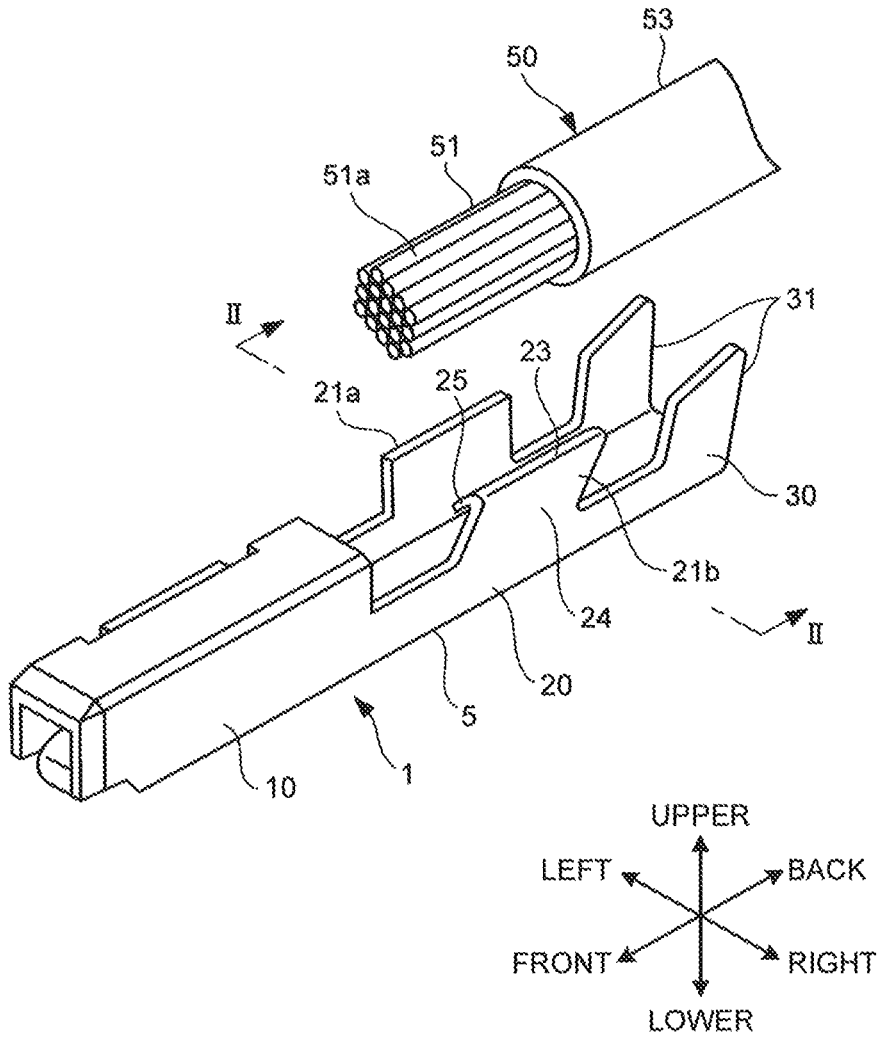
FIG. 1 is a perspective view illustrating a crimp terminal, according to an embodiment, before crimping and an electrical wire.

As illustrated in FIG. 1, a crimp terminal 1 is formed by press-molding a conductive metal plate and includes an electrical connection portion 10 which connects one end side (a front side) in a longitudinal direction (front and back direction) thereof to such as a mating terminal. Further, the crimp terminal 1 includes a conductor crimping portion 20 for caulking to an exposed conductor 51*a* of an electrical wire 50 on the other end side (a back side) of the longitudinal direction and a coating caulking portion 30 for caulking to an insulating coating 53 of the electrical wire 50.

In the above configuration, the exposed conductor 51*a* is a portion exposed from the insulating coating 53 at a tip of the electrical wire 50 including a conductor 51 and the insulating coating 53. The conductor 51 includes multiple bundles of strands in the form of a twisted wire. The insulating coating 53 is formed so as to coat a periphery of the conductor 51.

The electrical connection portion 10, the conductor crimping portion 20, and the coating caulking portion 30 include a common bottom plate 5.

The electrical wire 50 is an aluminum wire including a conductor made of aluminum or aluminum alloy. The electrical wire 50 may be a copper wire including a conductor made of copper.

The conductor crimping portion 20 is a portion having a U-shaped cross section in which a pair of conductor caulking pieces 21*a* and 21*b* is erected so as to extend upward on both end sides in the right and left direction of the bottom plate 5 extending continuously from the electrical connection portion 10. Multiple serrations (not illustrated) extending in the right and left direction are provided on an inner surface of the conductor crimping portion 20. Herein, "upward" means a direction (an upper direction in FIG. 1) separating from a surface contacting to the exposed conductor 51*a* of the bottom plate 15.

Figure 2:
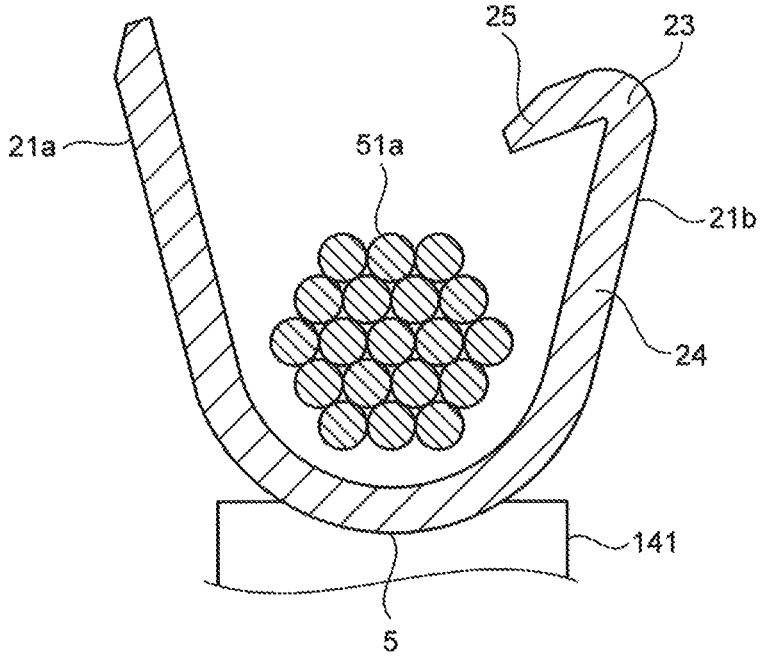
FIG. 2 is a II-II line sectional view in a state in which an electrical wire is set in a conductor crimping portion in the crimp terminal illustrated in FIG. 1.

The conductor caulking piece 21*a* which is one of a pair of the conductor caulking pieces 21*a* and 21*b* of the conductor crimping portion 20 is extended flat and upward from a bottom plate 5 without having a bending portion. On the other hand, as well illustrated in FIG. 2, the conductor caulking piece 21*b* which is the other one of a pair of the conductor caulking pieces 21*a* and 21*b* has a bending portion 23 by being folded and includes a base end 24 positioned on a base end side from the bending portion 23 and a tip 25 positioned on a tip side from the bending portion 23. The other conductor caulking piece 21*b* is formed so that the tip 25 positioned on the tip side from the bending portion 23 faces downward (the bottom plate 5 direction or the conductor caulking piece 21*a* direction, and the bottom plate 5 direction from a tip of the conductor caulking piece 21*a*). Specifically, the other conductor caulking piece 21*b* is formed so that an extending direction of the tip 25 crosses an extending direction of the bottom plate 5. In other words, the other conductor caulking piece 21*b* is formed so as to include a portion positioned lower than the bending portion 23 between the bending portion 23 and the tip. Further, the tip 25 is preferably formed so as to face the exposed conductor 51*a* since the tip 25 is easy to stick into the exposed conductor 51*a* in a crimping process to be described later.

Figure 3:
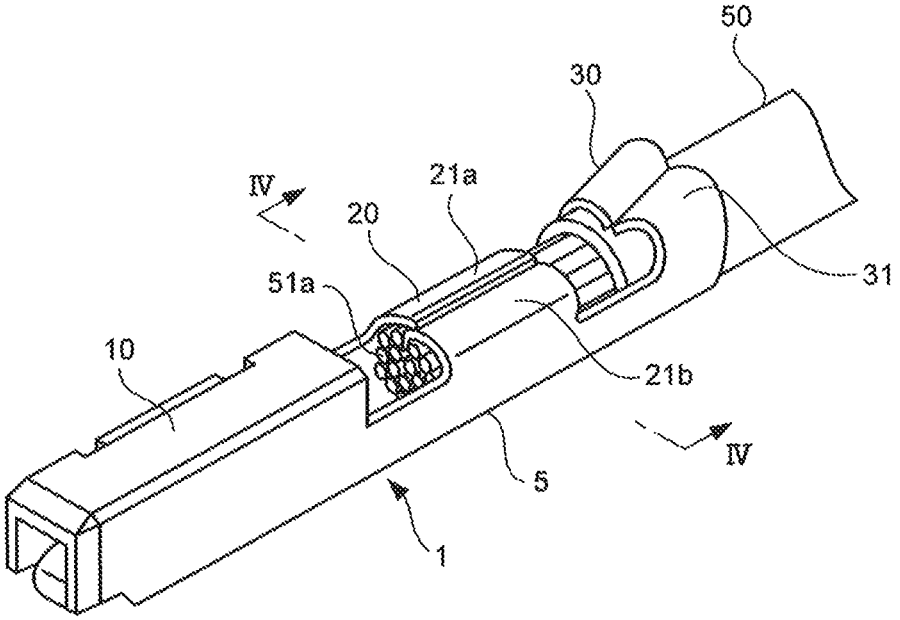
FIG. 3 is a perspective view illustrating an appearance of a crimping structure in which the crimp terminal illustrated in FIG. 1 is crimped to an electrical wire.
Figure 4:
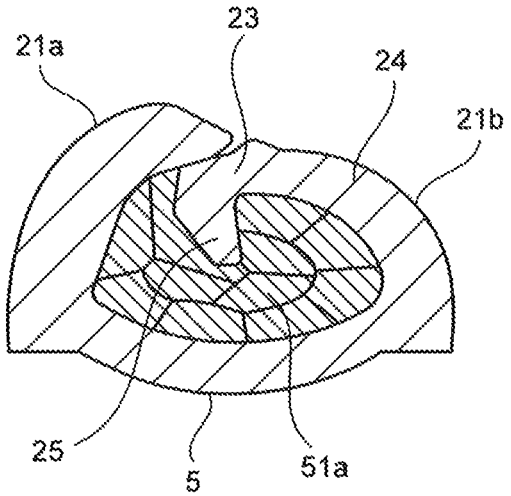
FIG. 4 is a IV-IV line sectional view of a conductor crimping portion in the crimp terminal illustrated in FIG. 3.

The conductor crimping portion 20 caulks the exposed conductor 51*a* of the electrical wire 50 as illustrated in FIG. 3 in the crimping process to be described later. At this time, as illustrated in FIG. 4, a pair of the conductor caulking pieces 21*a* and 21*b* is bent inward so that the one conductor caulking piece 21*a* overlaps on an upper side of the other conductor caulking piece 21*b* and so that the exposed conductor 51*a* of the electrical wire 50 to be connected is wrapped, and thereby a pair of the conductor caulking pieces 21*a* and 21*b* caulks the exposed conductor 51*a* so that the exposed conductor 51*a* is closely contacted on an upper surface of the bottom plate 5.

A structure of the crimp terminal 1 will be described again with reference to FIGS. 1 and 2.

The coating caulking portion 30 is a portion having a U-shaped cross section in which a pair of coating caulking pieces 31 and 31 is erected so as to extend upward on both end sides in a right and left direction of the bottom plate 5 extending continuously from the conductor crimping portion 20. The coating caulking portion 30 of the conductor crimping portion 20 is arranged at proper intervals in a front and back direction.

Next, a crimping process of the crimp terminal 1 will be described. Although this crimping process is not illustrated, it can be basically described by applying a first crimping process to a sixth crimping process in a conventional crimping structure illustrated in FIGS. 8(*a*) to 8(*f*) which have been described above.

In the description to be described below, an upper die and a lower die will be described by applying the lower die 141 and the upper die 143 illustrated in FIG. 8(*a*).

Specifically, when the conductor crimping portion 20 of the crimp terminal 1 is crimped to the exposed conductor 51*a*, first the crimp terminal 1 is mounted on the lower die (anvil) 141, and the exposed conductor 51*a* is inserted between the conductor caulking pieces 21*a* and 21*b* and mounted on the bottom plate 5. Then, by gradually descending the upper die (crimper) 143, a tip side of the conductor caulking pieces 21*a* and 21*b* on an inner side of the upper die is gradually tilted inward, and finally the conductor caulking pieces 21*a* and 21*b* are bent so as to wrap the exposed conductor 51*a*. More specifically, the conductor caulking pieces 21*a* and 21*b* are gradually bent in a state in which the one conductor caulking piece 21*a* formed flat is positioned on an upper side of the other conductor caulking piece 21*b* including the tip 25 facing downward. Then, first a tip of the tip 25 of the other conductor caulking piece 21*b* contacts to the exposed conductor 51*a* and bites and sticks into the exposed conductor 51*a*. After that, as illustrated in FIG. 4, the exposed conductor 51*a* of the electrical wire 50 is caulked by the conductor crimping portion 20 and closely contacted to an upper surface of the bottom plate 5 and the conductor caulking pieces 21*a* and 21*b*. In the coating caulking portion 30, a pair of the coating caulking pieces 31 and 31 is caulked to the insulating coating 53 of the electrical wire 50 in advance as with the above description before caulking of the conductor crimping portion 20.

As a result of this, as illustrated in FIG. 4, a pair of the conductor caulking pieces 21*a* and 21*b* caulks the exposed conductor 51*a* by being bent so that the one conductor caulking piece 21*a* overlaps on an upper side of the other conductor caulking piece 21*b*. Further, a pair of the conductor caulking pieces 21*a* and 21*b* caulks the exposed conductor 51*a* so that the tip 25 of the other conductor caulking piece 21*b* sticks into the exposed conductor 51*a*. In the embodiment, the tip 25 sticks into the exposed conductor 51*a* in a state of being substantially orthogonally folded with respect to the base end 24 at the bending portion 23. Specifically, the tip 25 bites into the exposed conductor 51*a* so that an extending direction of the tip 25 is substantially orthogonal to a plane along the bottom plate 5.

As described above, in the crimping structure according to the embodiment, the tip 25 of the other conductor caulking piece 21*b* is formed so as to stick into the exposed conductor 51*a*. Therefore, the other conductor caulking piece 21*b* and the exposed conductor 51*a* are firmly connected. Especially, in the embodiment, the tip 25 sticks into the exposed conductor 51*a* in a state of being substantially orthogonally folded at the bending portion 23. Therefore, the tip 25 of the other conductor caulking piece 21*b* can be stuck deeply into the exposed conductor 51*a*, and the other conductor caulking piece 21*b* and the exposed conductor 51*a* are further firmly connected.

FIGS. 5A, 5B, 5C, and 5D are explanatory views illustrating a fixing force of a crimping portion in the crimping structure illustrated in FIG. 3 for comparison with other crimping structures.

Figure 5A:
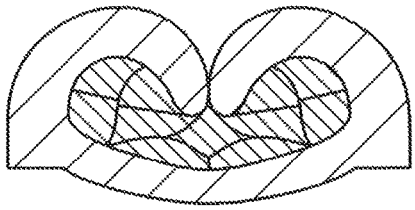
FIG. 5A is an explanatory view of a crimping structure applying a conventionally known B crimp shape.

FIG. 5A is an explanatory view of a crimping structure applying a conventionally known B crimp shape.

Figure 5B:
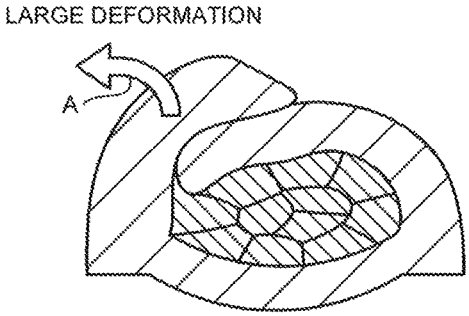
FIG. 5B is an explanatory view of a crimping structure applying a conventional overlap shape illustrated in FIGS. 7 and 8.
Figure 7:
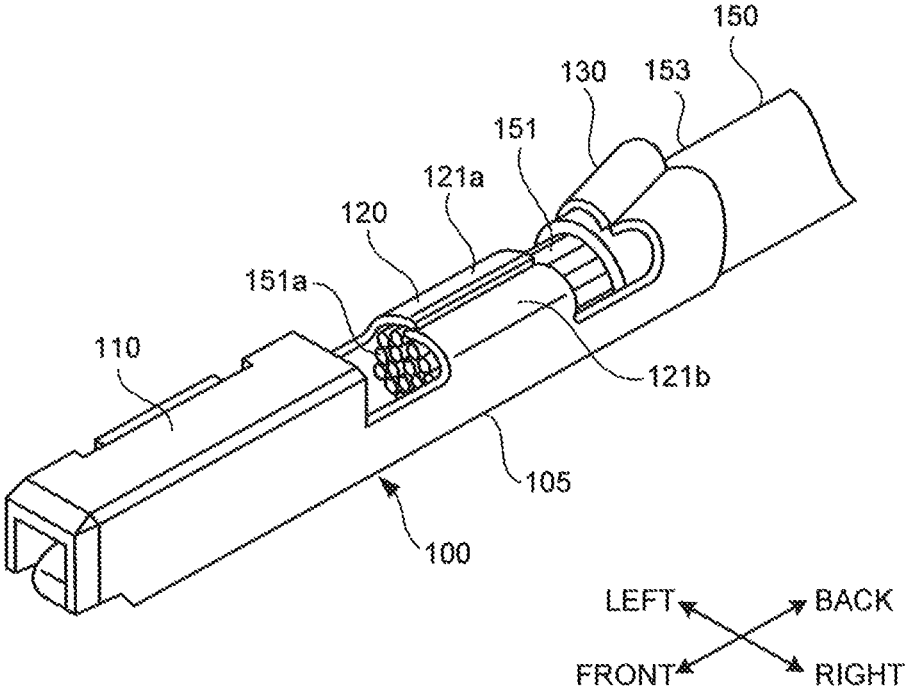
FIG.7 (Prior Art)
FIG. 7 is a perspective view illustrating an appearance of a crimping structure in which a conventional crimp terminal is crimped to an electrical wire.
Figure 8:
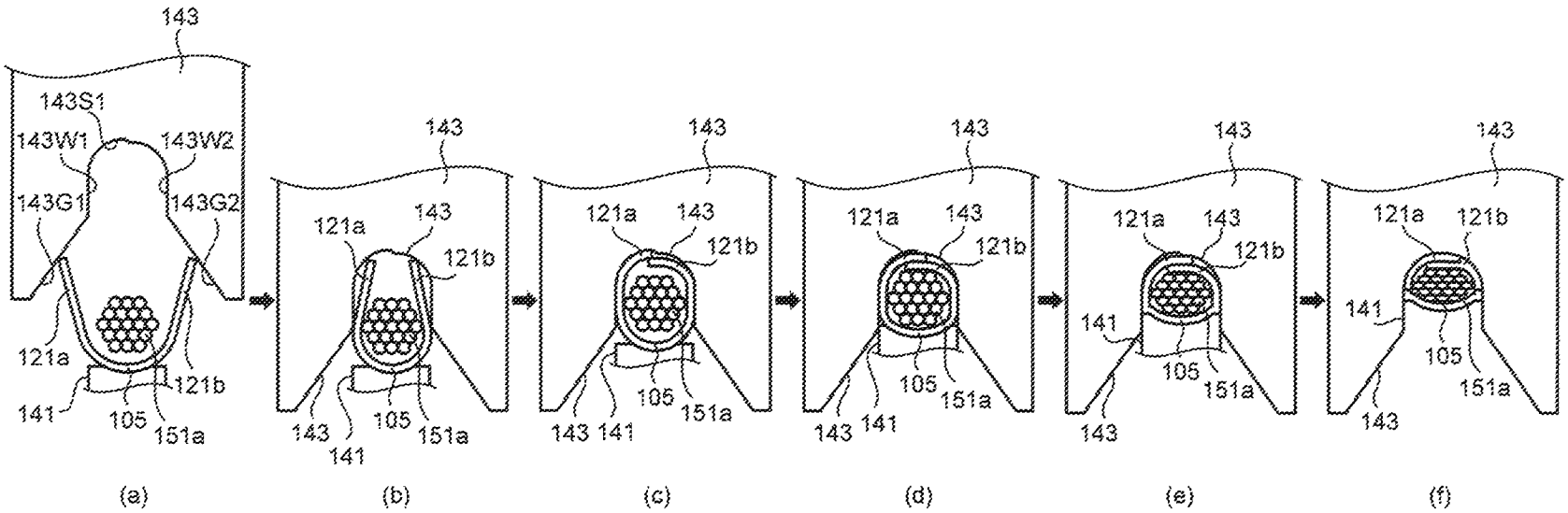
FIG.8 (Prior Art)
FIG. 8 is a view illustrating a crimping process in the crimping structure illustrated in FIG. 7.

FIG. 5B is an explanatory view of a crimping structure applying a conventional overlap shape illustrated in FIGS. 7 and 8.

Figure 5C:
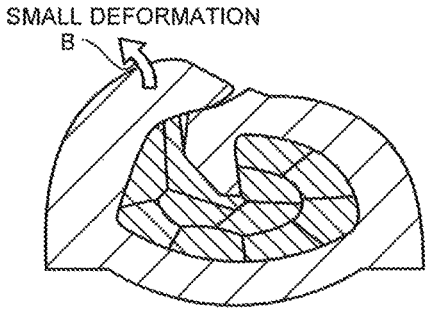
FIG. 5C is an explanatory view of a crimping structure according to the embodiment.

FIG. 5C is an explanatory view of a crimping structure according to the embodiment.

Figure 5D:
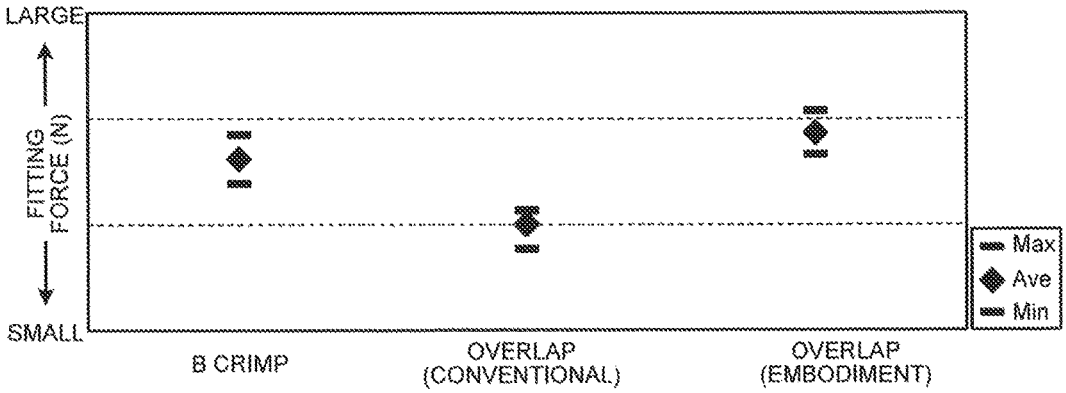
FIG. 5D is a view for comparing and describing a fixing force in each of the crimping structures illustrated in FIGS. 5A to 5C.

FIG. 5D is a view for comparing and describing a fixing force in each of the crimping structures illustrated in FIGS. 5A to 5C.

As illustrated in FIG. 5D, in the crimping structure according to the embodiment, which is illustrated in FIG. 5C, a fixing force in the case of crimping by the conductor crimping portion 20 is large in comparison with the crimping structure applying the B crimp shape illustrated in FIG. 5A and the crimping structure applying the conventional overlap shape illustrated in FIG. 5B.

Thus, the other conductor caulking piece 21*b* and the exposed conductor 51*a* are firmly connected in comparison with a conventional example. Therefore, a restoring force occurred to the conductor caulking pieces 21*a* and 21*b* due to such as spring back after being caulked can be reduced, and opening of the conductor caulking pieces 21*a* and 21*b* can be prevented. Specifically, in the embodiment as illustrated by an arrow A in FIG. 5B and an arrow B in FIG. 5C, which illustrate a deformation amount (restoring force) in terms of image, the deformation amount is relatively small, and the other conductor caulking piece 21*b* and the exposed conductor 51*a* are firmly connected, and therefore a restoring force acting on the conductor caulking piece 21*a* on an upper side is small in comparison with the case of applying the crimping structure applying the conventional overlap shape illustrated in FIG. 5B. As a result of this, it is prevented that a contact pressure with respect to the exposed conductor 51*a* of the conductor caulking pieces 21*a* and 21*b* becomes weak, and mechanical strength and electrical connection performance of a crimping portion can be secured. Further, according to the crimping structure according to the embodiment, in the case of using an aluminum wire including a conductor made of aluminum or aluminum alloy as with the embodiment, opening of the conductor caulking piece can be prevented.

The crimp terminal 1 according to the embodiment will be summarized below.

(i) The crimp terminal 1 according to the embodiment includes the conductor crimping portion 20 having a U-shaped cross section and including the bottom plate 5 and a pair of the conductor caulking pieces 21*a* and 21*b* extending upward from both end sides of the bottom plate 5. Further, by the crimp terminal 1, a pair of the conductor caulking pieces 21*a* and 21*b* is bent inward so that the one conductor caulking piece 21*a* overlaps on an upper side of the other conductor caulking piece 21*b* and so that the conductor 51 of the electrical wire 50 to be connected is wrapped, and thereby a pair of the conductor caulking pieces 21*a* and 21*b* caulks the conductor 51 so as to closely contact on an upper surface of the bottom plate 5. The other conductor caulking piece 21*b* includes the bending portion 23 by being folded, and is formed so that the tip 25 positioned at a tip side from the bending portion 23 faces downward.

(ii) The crimping structure with respect to an electrical wire of a crimp terminal according to the embodiment includes the crimp terminal 1 having the above configuration (i) and the electrical wire 50 in which the crimp terminal 1 is crimped. A pair of the conductor caulking pieces 21*a* and 21*b* caulks the conductor 51 so that the tip 25 of the other conductor caulking piece 21*b* sticks into the conductor 51 (exposed conductor 51*a*).

(iii) In the crimping structure with respect to an electrical wire of a crimp terminal according to the embodiment, the tip 25 of the other conductor caulking piece 21*b* further sticks into the conductor 51 in a state in which the tip 25 of the other conductor caulking piece 21*b* is substantially orthogonally folded at the bending portion 23.

(iv) The crimping structure with respect to an electrical wire of a crimp terminal according to the embodiment, the electrical wire 50 is an aluminum wire including a conductor made of aluminum or aluminum alloy as the conductor 51.

As described above, in the crimp terminal having the above configuration, a tip of the other conductor caulking piece, which is bent so as to position at a lower side of one conductor caulking piece after being caulked, is formed so as to face downward. Therefore, a conductor is caulked by the conductor caulking piece so that the tip of the other conductor caulking piece sticks into the conductor. Accordingly, the other conductor caulking piece and the conductor are further firmly connected, and a restoring force occurred to the conductor caulking pieces due to such as spring back after being caulked can be reduced, and opening of the conductor caulking piece can be prevented. As a result of this, it is prevented that a contact pressure of the conductor caulking piece with respect to the conductor becomes weak, and mechanical strength and electrical connection performance of a crimping portion can be secured.

In a crimping structure with respect to an electrical wire of a crimp terminal having the above configuration, a conductor is caulked so that a tip of the other conductor caulking piece sticks into the conductor. Accordingly, the other conductor caulking piece and the conductor are further firmly connected, and a restoring force occurred to the conductor caulking pieces due to such as spring back after being caulked can be reduced, and opening of the conductor caulking piece can be prevented. As a result of this, it is prevented that a contact pressure of the conductor caulking piece with respect to the conductor becomes weak, and mechanical strength and electrical connection performance of a crimping portion can be secured.

In a crimping structure with respect to an electrical wire of a crimp terminal having the above configuration, a tip of the other conductor caulking piece in a state of being substantially orthogonally folded at a bending portion sticks into the conductor. In this configuration, the tip of the other conductor caulking piece can be stuck deeply into the conductor, and the other conductor caulking piece and the conductor can be more firmly connected.

A crimping structure with respect to an electrical wire of a crimp terminal having the above configuration is applied to an aluminum wire including a conductor made of aluminum or aluminum alloy. Therefore, even in the case of using a conductor made of aluminum or aluminum alloy which is less strong and ductile in comparison with a conductor made of copper, opening of the conductor caulking piece can be prevented.

According to the present invention, a crimp terminal capable of preventing that a conductor caulking piece opens after being caulked and a crimping structure with respect to an electrical wire of the crimp terminal can be provided.

A technical scope of the present invention is not limited to the above-described embodiment. The above-described embodiment can be variously deformed and improved within the technical scope of the present invention.

For example, the following variation will be considered.

Figure 6A:
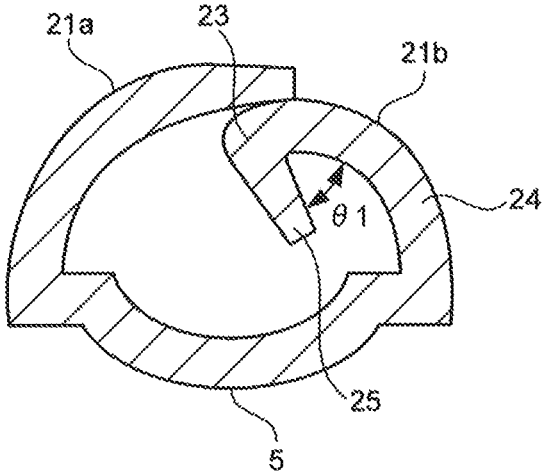
FIG. 6A is a sectional view illustrating a conductor crimping portion according to a variation.
Figure 6B:
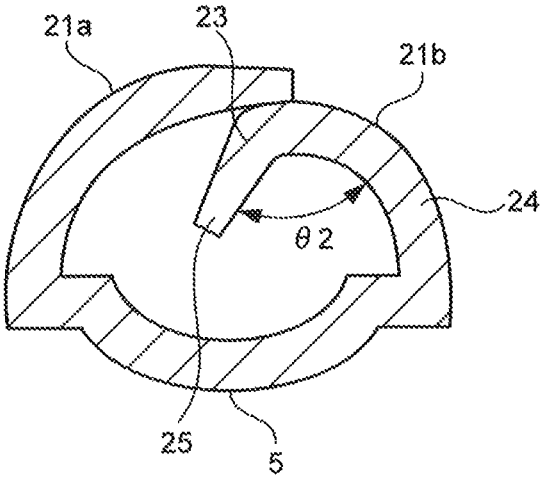
FIG. 6B is a sectional view illustrating a conductor crimping portion according to the variation.

FIGS. 6A and 6B are sectional views illustrating a conductor crimping portion according to the variation.

In FIGS. 6A and 6B, the exposed conductor 51*a* is omitted to easily recognize a structure. In the above-described embodiment, the tip 25 sticks into the exposed conductor 51*a* in a state of being substantially orthogonally folded with respect to the base end 24 at the bending portion 23. However, an angle in which the tip 25 sticks into the exposed conductor 51*a* is not limited to the above. For example, as illustrated in FIG. 6A, the tip 25 may stick into the exposed conductor 51*a* in a state of bending at an acute angle with respect to the base end 24 at the bending portion 23. Specifically, an angle θ1 with respect to the base end 24 of the tip 25 may be smaller than 90°. Alternatively, as illustrated in FIG. 6B, the tip 25 may stick into the exposed conductor 51*a* in a state of bending at an obtuse angle with respect to the base end 24 at the bending portion 23. Specifically, an angle θ2 with respect to the base end 24 of the tip 25 may be larger than 90°.

What is claimed is:

1. A crimp terminal, comprising:

a conductor crimping portion having a U-shaped cross section and including a bottom plate and a pair of conductor caulking pieces extending upward from both side edges of the bottom plate, wherein a first conductor caulking piece of the pair of conductor caulking pieces is substantially extended flat from the bottom plate without having a bending portion prior to caulking a conductor of an electrical wire to be connected, a second conductor caulking piece of the pair of conductor caulking pieces includes a bending portion being folded and formed so that a tip positioned at a tip side from the bending portion faces downward, the pair of conductor caulking pieces is formed to bend inward so that the tip and a base end of the second conductor caulking piece intersect at the bending portion, the first conductor caulking piece overlaps on an upper side of the second conductor caulking piece and the conductor of the electrical wire to be connected is wrapped, and thereby the pair of the conductor caulking pieces caulks the conductor so as to closely contact on an upper surface of the bottom plate, the tip of the second conductor caulking piece sticks into the conductor at a center position in a right and left direction of the conductor, and the tip of the second conductor caulking piece extends linearly.

2. A crimping structure with respect to an electrical wire of a crimp terminal, comprising:

a crimp terminal, the crimp terminal comprising:

a conductor crimping portion having a U-shaped cross section and including a bottom plate and a pair of conductor caulking pieces extending upward from both side edges of the bottom plate, wherein a first conductor caulking piece of the pair of conductor caulking pieces is substantially extended flat from the bottom plate without having a bending portion prior to caulking a conductor of an electrical wire to be connected, a second conductor caulking piece of the pair of conductor caulking pieces includes a bending portion being folded and formed so that a tip positioned at a tip side from the bending portion faces downward, the pair of the conductor caulking pieces is formed to bend inward so that the tip and a base end of the second conductor caulking piece intersect at the bending portion, the first conductor caulking piece overlaps on an upper side of the second conductor caulking piece and the conductor of the electrical wire to be connected is wrapped, and thereby the pair of the conductor caulking pieces caulks the conductor so as to closely contact on an upper surface of the bottom plate;

the electrical wire in which the crimp terminal is crimped, wherein the pair of conductor caulking pieces caulks the conductor so that the tip of the second conductor caulking piece sticks into the conductor at a center position in a right and left direction of the conductor, and the tip of the second conductor caulking piece extends linearly.

3. The crimping structure with respect to the electrical wire of the crimp terminal according to claim 2, wherein the electrical wire is an aluminum wire including a conductor made of aluminum or aluminum alloy as the conductor.

4. The crimping structure with respect to the electrical wire of the crimp terminal according to claim 2, wherein the conductor crimping portion further comprises a plurality of serrations formed on an inner surface thereof.

* * * * *